US006739285B2

(12) United States Patent
Mehrotra et al.

(10) Patent No.: US 6,739,285 B2
(45) Date of Patent: May 25, 2004

(54) INTRAVAGINAL RETENTION DEVICE FOR A TAILED ANIMAL

(75) Inventors: Vikram P. Mehrotra, Wildwood, MO (US); Chris R. Redford, Webster Groves, MO (US)

(73) Assignee: Monsanto Technology LLC, St. Louis, MO (US)

( * ) Notice: Subject to any disclaimer, the term of this patent is extended or adjusted under 35 U.S.C. 154(b) by 32 days.

(21) Appl. No.: 10/124,957

(22) Filed: Apr. 18, 2002

(65) Prior Publication Data

US 2002/0156438 A1 Oct. 24, 2002

Related U.S. Application Data

(60) Provisional application No. 60/285,316, filed on Apr. 20, 2001.

(51) Int. Cl.[7] ..... B68B 5/00
(52) U.S. Cl. ..... 119/174; 606/193
(58) Field of Search ..... 119/174, 811; 54/78; 600/551; 604/385.03; 606/193

(56) References Cited

U.S. PATENT DOCUMENTS

| | | | | | |
|---|---|---|---|---|---|
| 249,743 | A | * | 11/1881 | Butchers | 54/78 |
| 3,297,020 | A | | 1/1967 | Mathiesen | 600/551 |
| 4,467,806 | A | * | 8/1984 | Bhiwandiwala et al. | 606/193 |
| 5,881,673 | A | * | 3/1999 | Beach et al. | 119/174 |

* cited by examiner

*Primary Examiner*—Robert P. Swiatek
(74) *Attorney, Agent, or Firm*—Grace L. Bonner; Gary M. Bond; Howrey Simon Arnold & White, LLP

(57) ABSTRACT

Tail-mounted devices and methods for securing an object in an animal's, preferably a cow's, vagina, the device typically comprising a first and second tail anchor or ring, and a tether attached to the first tail anchor. The invention is most suited for and capable of attachment to a housing or object that is inserted into the cow's vagina. The purpose of the disclosed devices and methods is to hold an object resident in the vagina for an extended periods of time, including periods of 14 days or longer.

22 Claims, 4 Drawing Sheets

INTRAVAGINAL RETENTION DEVICE FOR A TAILED ANIMAL

This application claims the benefit of U.S. Provisional Application Serial No. 60/285,316 filed Apr. 20, 2001, the entire contents of which is herein incorporated by reference.

BACKGROUND OF THE INVENTION

Commercial raising of cattle for dairy production requires proper management. In addition to the various husbandry concerns such as herd health and nutrition, a critical management area for economic survival of any cattle operation, is the breeding management of the cows.

Dairy cows are managed intensely and there are costs associated with breeding the cow, how long it takes each cow to become pregnant, as well as associated labor costs. Economics of a dairy make it important to both minimize the amount of time a dairy cow is not pregnant and yet still have a high probability of the cow becoming pregnant.

It is estimated that for every day past a set goal date that a cow remains non-pregnant or open, there is an economic loss of between $1.00-$3.00 per day. An average sized dairy herd is between 200 to 1,000 cows. If the 24 hours during which the cow should be bred is missed for each cow, this represents an economic loss of $4,200.00 to $21,000.00 annually. Often cows are not successfully bred for as many as 3 estrous cycles, due to infertility, infections and semen-related problems. If one half of the cows in a herd of 200 to 1,000 is not impregnated for 3 cycles, the estimated economic loss increases to $6,300.00 to $31,500.00 annually. These projections of economic loss to the producer demonstrate the critical importance of the cow spending the majority of each year producing milk.

Annually 1 million dairy cows are culled for reproductive failure, for reasons such as infertility and infections.

To improve the management of dairy cows and decrease the economic losses associated with the non-pregnant interval it is desirable to have additional options and management tools other than culling the animals.

Many of the problems, such as missed estrous cycles, infertility, infections and semen-related problems are best managed by direct, local intervention and management applied to the cow's reproductive tract. These types of intervention and management include, but are not limited to introducing devices into the vagina of the cow for monitoring their estrous cycle, managing the cycle by introduction of hormones or steroids or introducing therapeutic agents for example antibiotics and antimycotics.

One problem with managing cow at the local level of the vagina is the difficulty of effectively retaining any type of device in the animal's vagina over any length of time. There is a tendency for objects that have been introduced into the vagina to passively come out, to be expelled from the animal, or to be pulled out by the subject animal or one of its herdmates. To effect local vaginal intervention and management for cow health and productivity, a reliable retention device is needed.

BRIEF SUMMARY

The present invention is a tail-mounted retention device for securing an object in an animal's vagina, the device comprising a first and second tail anchor or ring, and a tether attached to at least the first tail anchor. The invention is most suited for attachment to a housing or device that is inserted into the cow's, or other tailed-animal's vagina. The invention functions to hold the object resident in the vagina.

DESCRIPTION OF ILLUSTRATIVE EMBODIMENTS

Figure 1:
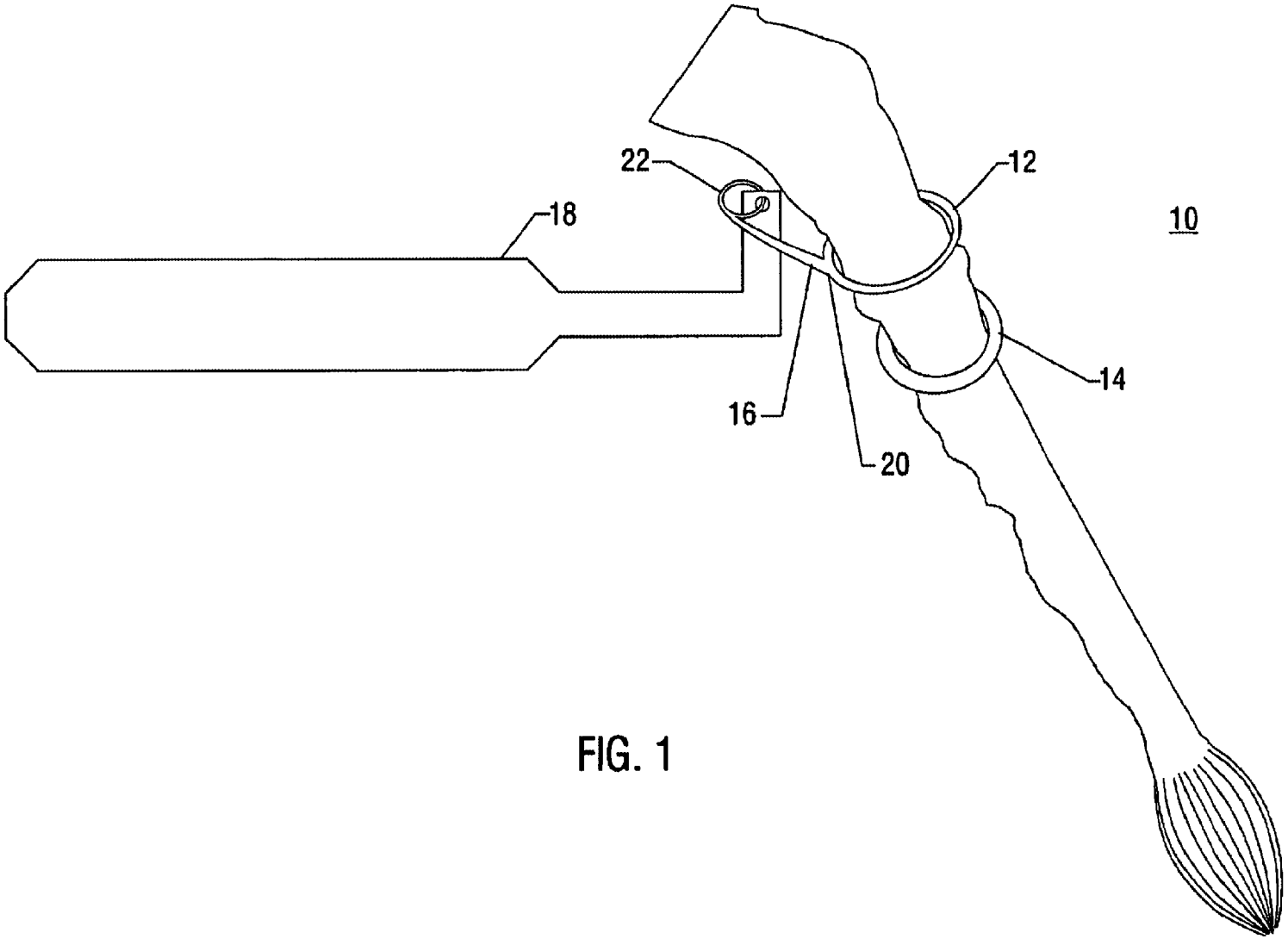
FIG. 1 is a schematic drawing of an embodiment of the invention.
Figure 2:
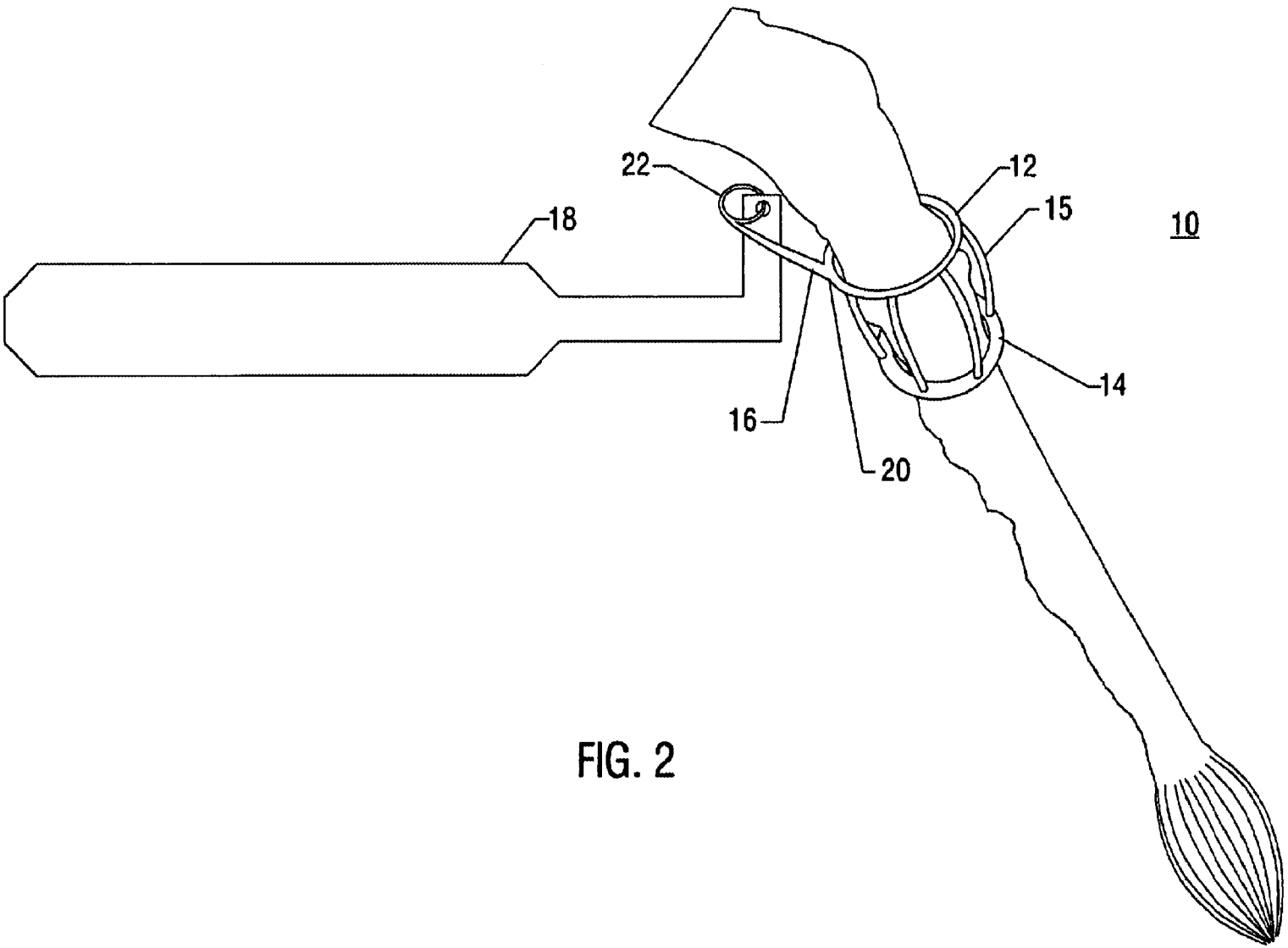
FIG. 2 is a schematic of a second embodiment of the invention
Figure 3:
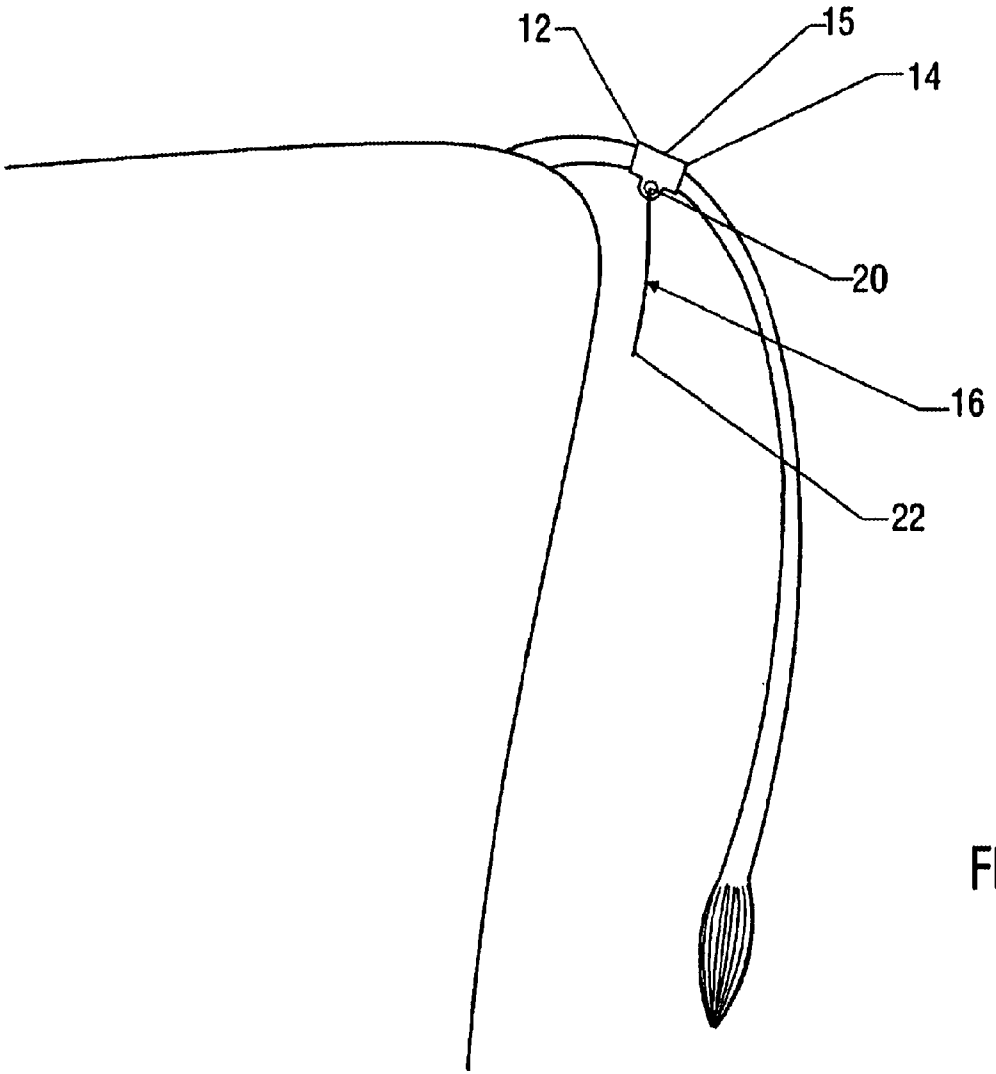
FIG. 3 is a schematic of a another embodiment of the invention, in an environmental view.
Figure 4:
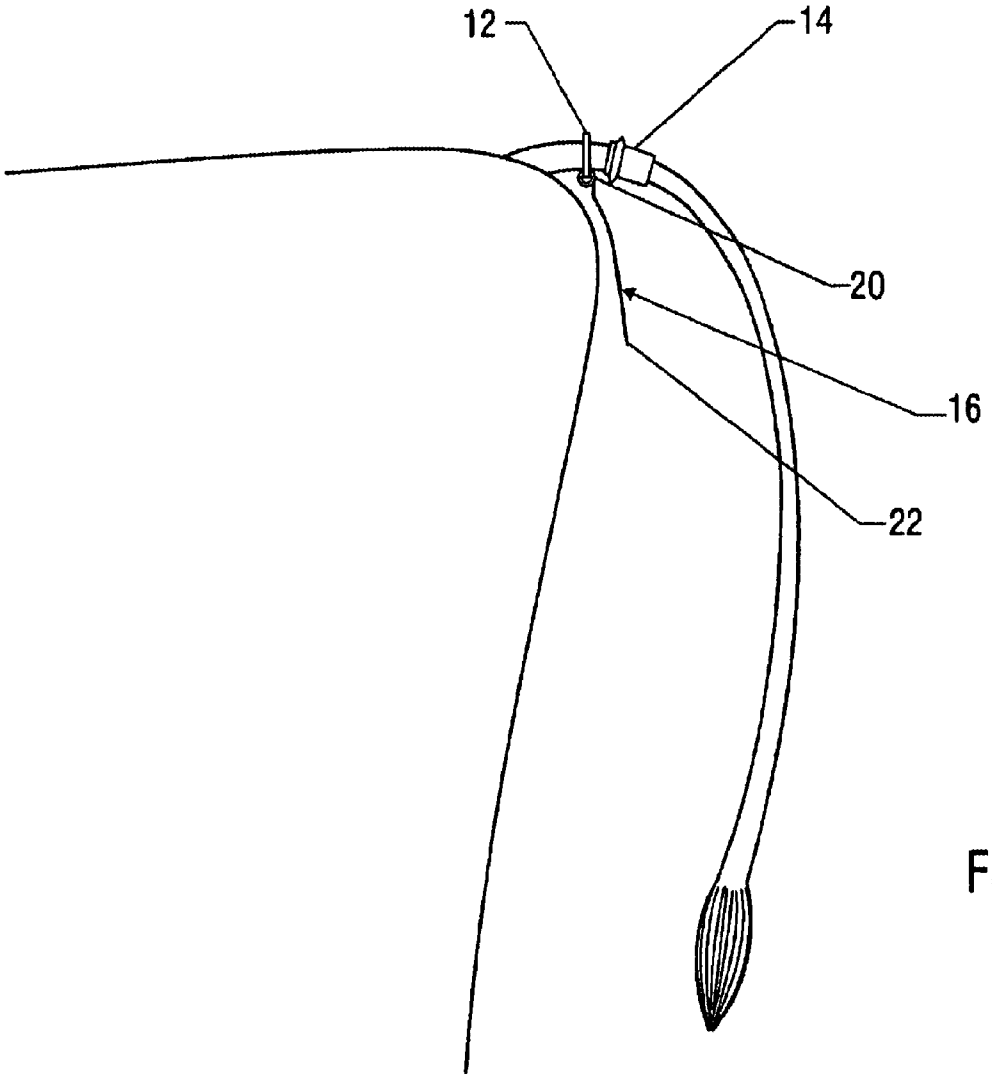
FIG. 4 is a schematic of another embodiment of the invention

An intravaginal retention device 10 is designed that can be successfully used to retain a device in a cow's vagina for any desired period time and may be for a contiguous period of 14 days or longer. The instant device 10 is comprised of a first tail anchor or ring 12, a second tail anchor or ring 14 disposed proximately to the first tail anchor or ring 12, both of which may substantially surround the tail of the animal, a tether 16 of specified length and optionally, main body or housing 18. Although it is not necessary for anchors 12 and 14 to be annular in shape or completely encircle the animal's tail, for purposes of clarity and example, anchor 12 and 14 are described herein as either "rings" or "anchors." Furthermore, it is also envisioned that the rings or anchors may be adjustable in size. For example, they may comprise a VELCRO™ fastening means which renders them capable of being adapted for use on a variety of tail diameters.

The length of tether 16 allows the device 10 to move slightly but prevents housing 18 from being expelled or pulled from the animal's vagina. The first tail ring or anchor 12 is prevented from slipping down the tail (which then could lead to expulsion of the housing 18) by a second tail ring or anchor 14 on the tail, most preferably located caudally (i.e., towards the end of the tail rather than body) and in close proximity to first tail ring 12. The position of second tail ring 14 on the tail is preferably about 5 cm down from the tail head, but in any event second tail ring 14 is anatomically positioned so that movement of first tail ring 12 on the cow's, or other animal's, tail will not cause sufficient tension on tether 16 to dislodge housing 18 from the cow's vagina.

Various embodiments of the invention provide for 10 device, suitable for securing an object 18 in a tailed animal's vagina, wherein the device comprises:

(i) a first anchor 12, capable of being disposed in proximity to the animals tail. In a particular aspect of this embodiment the first anchor comprises a ring capable of substantially encircling the animal's tail, where the ring is of sufficient size to allow it to travel substantially freely along a predetermined segment of the animal's tail.

(ii) A second anchor 14 capable of being disposed in a substantially immovable and fixed position relative the animal's tail so that it can limit the movement of the first anchor, with respect to the animal's tail. In various aspects of this embodiment of the invention the second anchor 14 is capable of being attached either closer to, or farther from the tip of the animals tail, with respect to the first anchor 12.

(iii) A tether means 16, having a first end 20 capable of being connected to the first anchor and a second end 22 capable of being connected to an object in the animal's vagina. The tether 16 is typically sufficiently short, rigid, and/or inelastic that it is capable of ensuring that an object inserted into the animal's vagina is not expelled or pulled out, if the object inserted into the animal's vagina and the device is attached to the animal.

In various aspects of this embodiment the first anchor 12 and second anchor 14 are either: (a) not connected to one another but, nevertheless capable of being disposed proximately to one another on an animal's tail so that the second anchor 14 is nearer to the distal end (tip) of the animal's tail, (b) connected by a rigid connecting means which provides structural support capable of maintaining a substantially constant distance between the first anchor 12 and second anchor 14, or (c) connected by a flexible connecting means capable of allowing substantially free movement of the first anchor 12 with respect to the second anchor 14 over a distance limited by the flexible connecting means. Additionally, the device is capable of securing an object in an animal's vagina for a contiguous period of 14 days, or longer.

In some embodiments first ring 12 and second 14 may be in spaced apart, fixed connection with each other, such as by means of one or more connectors 15. When the first and second rings are connected, the connection may be either rigid (such that it provides specific structure) or flexible so as to allow some movement of the two rings in relation to one another.

When the connection between the first and second rings is rigid it is envisioned that the first anchor will be made of or comprise a flexible (elastic) material or alternatively will comprise a spring-type mechanism so as to allow the animal to move its tail without pulling the device out of the animal's vagina. At the same time the first anchor will not comprise a component so pliable that it expands or stretches enough to allow the device to be expelled from the animal's vagina.

In embodiments where the second ring 14 is placed closer to the base (farther from the tip) of the animals tail than the first ring it is necessary that the rings be joined by a connecting means, either rigid or flexible (e.g., plastic or nylon string) so as to prevent the first ring from moving so far toward the tip of the tail that it allows the device to be expelled or pulled from the animal's vagina.

In other embodiments first ring 12 and second ring 14 are not connected to each other but are spaced proximately to each other in order to prevent tether 16 from becoming so taut as to cause housing 18 to be dislodged from the cow's vagina.

The optional main body 18 of device 10 can be made hollow to accommodate sensors and electronics to use it as sensing device to measure various parameters that indicate an animal's status. It can also be used as a vaginal drug delivery device by attaching drug delivery device or other components with the retention device 10.

Tether 16 may comprise a means for fixedly or removably attaching the tether to the optional main body 18. Likewise, tether 16 may comprise a means for fixed or removable attachment to the first tail anchor or ring 12. Means by which tether 16 may be attached to either main body 18 and/or first tail ring 12 include, but are not limited to integral manufacture with main body 18, swivel-ring or other rotating means attachment, velcro, any detent mechanism, any type of clasp or clip, permanent attachment by glue, screws, rivets, welding or other appropriate means of attachment. The tether 16 is most preferably composed of any non-stretchable plastic, metal, silk or any other appropriate material, however materials that have stretch or elastic characteristics may also be used. Regardless of the material used the tether should be of such length, rigidity, and/or inelasticity so as to prevent the main body 18 from being expelled from the vagina when it is attached to the second end of the tether.

The main body 18 of the device 10 can be made out of any biocompatible material, such as plastics, metals, and elastomeric or spongy materials or any suitable composite materials. Both first tail ring 12 and second tail ring 14 may be composed of plastics, metals, elastomeric or spongy materials or combinations thereof. It is not necessary for the first ring 12 and second ring 14 to be made of the same material. For example first ring 12 may be manufactured of metal or plastic and second ring 14 may be composed of a spongy material or a series of circumferences of elastomeric tape around the animal's tail.

In any embodiment of the invention, first ring 12 and second ring 14 must be sized appropriately in relation to the animal on which device 10 is going to be used. Rings 12 and 14 must surround and/or attach to the tail in such a fashion as to not constrict the tail and/or restrict the blood flow in the tail of the animal to an extent that such constriction and/or restriction causes tissue necrosis. The second ring 14 must be in sufficient fixed contact with the tail to prevent the caudal movement of first ring 12 past second ring 14 when the second ring is located in a position caudal to the first ring. First ring 12 may fit and surround the tail in such a fashion as to remain relatively fixed in position or may be sized to move somewhat freely along the animal's tail with respect to the second ring 14. One skilled in the art will recognize that although described as a ring or surround, second ring may be embodied by any apparatus that will by its size and means of being secured to the tail, stick in one place on the tail as an obstruction and prevent the downward movement on the tail of first ring 12. Second ring 14 therefore can in various embodiments comprise a sufficient protrusion of any shape and substance which is securely and substantially stationarily attached to the tail.

Device 10 is useful for heat detection, heat synchronization, intravaginal drug delivery and for measurement of physiological parameters.

Various embodiments of the instant invention, provide for methods of securing an object (e.g. the housing 18) in the vagina of the animal using any of the device embodiments described above, wherein the device 10 is placed on the animal, for example a cow, by securing first anchor or ring 12 to the upper or more cranial portion of the cow's tail, that is the end of the tail that is connected to the cow. The second tail anchor or obstruction 14 is positioned proximately to the first ring 12 but further from the cow's body and closer to the free end of the animal's tail. In various aspects of this embodiment of the instant method the first and second tail anchor are not connected to one another.

Nevertheless it is also contemplated that the second tail anchor 14 could also be placed closer to the proximal end (the base) of the cows tail than the first tail anchor 12, so long as the first and second anchors were functionally connected so as to ensure that the first tail anchor cannot move to a position which would allow the object (e.g. housing 18) to be pulled or expelled from the animal's vagina.

The two anchors are typically in close proximal relationship to each other and positioned in approximate alignment with the cow's vagina, as shown in the figures. A first end 20 of tether 16 is attached to first ring 12 in either a fixed or detachable manner. A second end 22 of tether 16 is may be attached to optional housing (or other object for vaginal insertion) 18, either in a fixed or detachable manner.

In some embodiments tether 16 may be articulated so that there may be an exterior portion and a portion that is actually resident within the vagina and there attached to optional housing 18, either in a fixed or detachable manner.

It is to be further understood that the specific embodiments of the present invention as set forth are not intended as being exhaustive or limiting of the invention, and that many alternatives, modifications, and variations will be apparent to those of ordinary skill in the art in light of the foregoing examples and detailed description. Accordingly, this invention is intended to embrace all such alternatives, modifications, and variations that fall within the spirit and scope of the following claims.

What is claimed is:

1. A device, suitable for securing an object in a tailed animal's vagina, comprising:

(a) a first anchor, capable of being disposed in proximity to the animal's tail and capable of movement with respect to the animal's tail;

(b) a second anchor disposed distally to the first anchor in a substantially fixed position relative to the animal's tail when in use so as to limit the movement of the first anchor, with respect to the animal's tail; and (c) a tether means, having a first end connected to the first anchor and a second end capable of being connected to an object in the animal's vagina.

2. The device of claim 1 wherein the first anchor and the second anchor are capable of being disposed proximately to one another on an animal's tail, so that the second anchor is nearer to the distal end (tip) of the tail.

3. The device of claim 1 wherein the second end of the tether means comprises a detachable connecting means.

4. The device of claim 1, wherein the tether means is of such length, rigidity, inelasticity, or a combination thereof that it is capable of ensuring that the object is not pulled or expelled from the animal's vagina after the object is inserted into the animal's vagina and the device is attached to the tail of the animal.

5. The device of claim 1 wherein the first anchor comprises a ring capable of substantially encircling the animal's tail loosely enough to allow the ring to travel substantially freely along a portion of the animals tail near the animal's vagina.

6. The device of claim 1 wherein the second anchor is a ring capable of being substantially immovably affixed to the animal's tail.

7. The device of claim 6 wherein the second anchor is capable of being attached to the animals tail at a location closer to the tip than the first anchor.

8. The device of claim 1 wherein one or both anchors are capable of being adjusted to be suitable for use on tails of more than one size.

9. The device of claim 1 capable of securing an object in the animal's vagina for a contiguous period of 14 days or longer.

10. The device of claim 1 wherein the first anchor and the second anchor are connected by a rigid connecting means which provides structural support capable of maintaining a substantially constant distance between the first and second anchors.

11. The device of claim 1 wherein the first anchor and the second anchor are connected by a flexible connecting means capable of allowing substantially free movement of the first anchor with respect to the second anchor over a distance limited by the flexible connecting means.

12. A combination of an object and a device suitable for securing the object in a tailed animal's vagina according to claim 1, wherein the object is capable of being retained in the animal's vagina.

13. A method of securing an object in the vagina of a tailed animal, said method comprising:

(a) attaching the object to a device comprising:

(i) a first anchor, fastened by a connecting means to (ii) a tether, having a first end comprising a connecting means wherein the first end is capable of being connected to the first anchor and a second end comprising a connecting means which is capable of being connected to the object, (iii) a second anchor capable of being disposed proximately to the first anchor, so as to limit the first anchor's movement in relation to the animal's vagina;

(b) inserting the object into the animal's vagina, and (c) attaching the first and second anchors to the animal, wherein the second anchor is attached to the animal so as to ensure that the object is not pulled or expelled from the animal's vagina.

14. The method of claim 13 wherein the first anchor comprises a ring suitable to substantially encircle the animal's tail loosely enough to allow the first anchor to freely travel along a portion of the length of the animal's tail.

15. The method of claim 13 wherein the first anchor and the second anchor are not connected to each other.

16. The method of claim 13 wherein the first anchor and the second anchor are connected:

(a) by a rigid connecting means for providing structural support so as to maintain a substantially constant distance between the first and second anchors.

17. The method of claim 13 wherein the second end of said tether comprises a detachable connecting means.

18. The method of claim 13 wherein the tether is of such length, rigidity, inelasticity, or a combination thereof that it substantially ensures that the object is not expelled or pulled from an animal's vagina, while the device is attached to the tail of the animal.

19. The method of claim 13 wherein the second anchor is attached at a position closer to the tip of the tail than the first anchor.

20. The method of claim 13 wherein the second anchor is attached at a position closer to the base of the tail than the first anchor.

21. The method of claim 13 wherein the device is suitable for securing the object in the animal's vagina for a contiguous period of 14 days or longer.

22. The method of claim 13 wherein the first anchor and the second anchor are connected by a flexible connecting means which allows movement of the first anchor with respect to the second anchor.

* * * * *